US011774155B2

(12) United States Patent
Sigmund et al.

(10) Patent No.: US 11,774,155 B2
(45) Date of Patent: Oct. 3, 2023

(54) ICEMAKER ASSEMBLY

(71) Applicant: WHIRLPOOL CORPORATION, Benton Harbor, MI (US)

(72) Inventors: Daniel Louis Sigmund, Denver, CO (US); Kevin Yunong Zhang, St. Joseph, MI (US)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 2 days.

(21) Appl. No.: 16/824,481

(22) Filed: Mar. 19, 2020

(65) Prior Publication Data

US 2021/0293462 A1 Sep. 23, 2021

(51) Int. Cl.

| | |
|---|---|
| ***F25C 1/04*** | (2018.01) |
| ***F25C 1/24*** | (2018.01) |
| ***F25D 17/06*** | (2006.01) |
| ***F25D 17/08*** | (2006.01) |

(52) U.S. Cl.

CPC ..... *F25C 1/04* (2013.01); *F25C 1/24* (2013.01); *F25D 17/062* (2013.01); *F25D 17/08* (2013.01); *F25C 2400/10* (2013.01); *F25C 2700/12* (2013.01)

(58) Field of Classification Search

CPC ..... F25C 1/24; F25C 1/04; F25C 2400/10; F25C 2700/12; F25C 5/20; F25C 5/22; F25C 5/24; F25D 17/062; F25D 17/08

See application file for complete search history.

(56) References Cited

U.S. PATENT DOCUMENTS

| | | | | |
|---|---|---|---|---|
| 3,382,682 | A | 5/1968 | Frohbieter | |
| 4,852,359 | A | 8/1989 | Mazzotti | |
| 6,351,955 | B1 * | 3/2002 | Oltman | F25C 1/04 62/353 |
| 6,438,988 | B1 | 8/2002 | Paskey | |
| 6,945,068 | B2 * | 9/2005 | Kim | F25D 17/045 62/353 |
| 7,185,508 | B2 | 3/2007 | Voglewede et al. | |
| 7,222,497 | B2 * | 5/2007 | An | F25C 1/04 415/213.1 |
| 9,234,690 | B2 | 1/2016 | McCollough et al. | |
| 10,415,866 | B2 | 9/2019 | Brabenec et al. | |
| 2013/0327082 | A1 * | 12/2013 | Son | F25C 1/24 62/344 |
| 2014/0144175 | A1 * | 5/2014 | Broadbent | F25D 23/003 62/340 |
| 2014/0260407 | A1 * | 9/2014 | Boehringer | F25C 5/22 62/344 |
| 2016/0258663 | A1 * | 9/2016 | Visin | F25D 17/065 |
| 2017/0307281 | A1 * | 10/2017 | Morgan | F25D 17/065 |
| 2019/0219317 | A1 | 7/2019 | Yoon et al. | |
| 2019/0331395 | A1 | 10/2019 | Choi | |

FOREIGN PATENT DOCUMENTS

| | | | | |
|---|---|---|---|---|
| CN | 108895740 A | * | 11/2018 | F25C 1/04 |
| JP | 11223450 A | | 8/1999 | |
| KR | 20060110549 A | | 10/2006 | |

* cited by examiner

*Primary Examiner* — Tavia Sullens

(74) *Attorney, Agent, or Firm* — PRICE HENEVELD LLP

(57) ABSTRACT

An icemaker assembly includes a housing that defines a slot. A tray is operably coupled to the housing and defines a plurality of recesses. A duct is coupled to the housing and is disposed around the slot. The duct directs cool air along the tray. A fan is operably coupled to the housing at an acute angle relative to a planar extent of the tray. The fan and the duct evenly distribute cool air along the tray.

18 Claims, 14 Drawing Sheets

ICEMAKER ASSEMBLY

BACKGROUND OF THE DISCLOSURE

The present disclosure generally relates to a refrigerating appliance, and more specifically, to an icemaker assembly for a refrigerating appliance.

SUMMARY OF THE DISCLOSURE

According to one aspect of the present disclosure, a refrigerating appliance includes an evaporator that is configured to output cool air into the refrigerating appliance. An icemaker is fluidly coupled to the evaporator. The icemaker includes a housing that defines at least one slot. A tray is operably coupled to the housing. The tray has a base and defines a plurality of recesses configured to receive a fluid. At least one duct is disposed around the at least one slot and is operably coupled to the evaporator. The at least one duct is configured to direct the cool air from the evaporator along the tray. At least one fan is positioned at an acute angle relative to the tray and is selectively coupled to the housing of the icemaker. The at least one fan and the at least one duct uniformly cool the tray.

According to another aspect of the present disclosure, a cooling system for an icemaker includes an evaporator that is configured to output cool air. A duct is coupled to the evaporator and is configured to redirect the cool air from the evaporator to the icemaker. A tray has a base and defines a plurality of recesses configured to receive a fluid. At least one fan is directed toward a plurality of recesses of the tray at an angle between 0-degrees and 90-degrees relative to a planar extent of the tray. The at least one fan and the duct uniformly freeze the fluid received by the plurality of recesses.

According to yet another aspect of the present disclosure, an icemaker assembly includes a housing that defines a slot. A tray is operably coupled to the housing and defines a plurality of recesses. A duct is coupled to the housing and is disposed around the slot. The duct directs cool air along the tray. A fan is operably coupled to the housing at an acute angle relative to a planar extent of the tray. The fan and the duct evenly distribute the cool air along the tray.

These and other features, advantages, and objects of the present disclosure will be further understood and appreciated by those skilled in the art by reference to the following specification, claims, and appended drawings.

Figure 1:
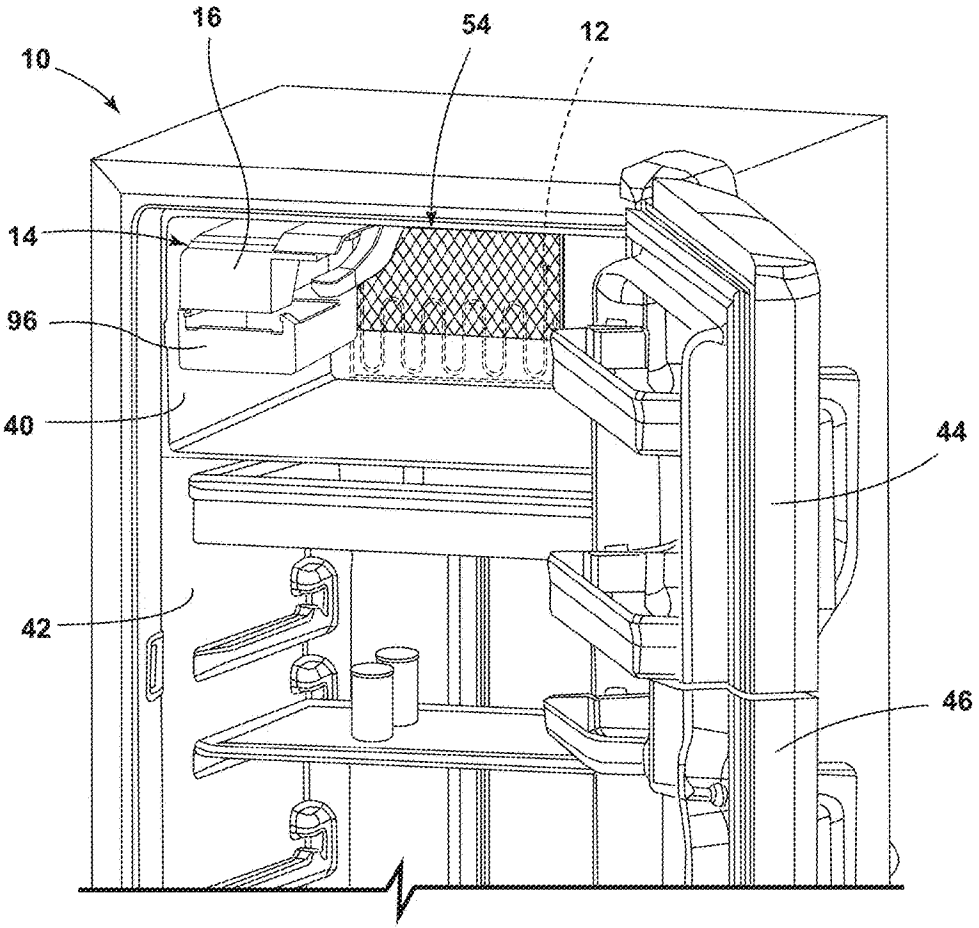
FIG. 1 is a partial front perspective view of a freezer compartment and a refrigeration compartment of a refrigerating appliance of the present disclosure.

The components in the figures are not necessarily to scale, emphasis instead being placed upon illustrating the principles described herein.

DETAILED DESCRIPTION

The present illustrated embodiments reside primarily in combinations of apparatus components related to an icemaker assembly. Accordingly, the apparatus components have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-14, reference numeral 10 generally designates a refrigerating appliance including an evaporator 12 that outputs cool air into the refrigerating appliance 10.

An icemaker 14 is fluidly coupled to the evaporator 12. The icemaker 14 includes a housing 16 that defines at least one slot 18. A tray 20 is operably coupled to the housing 16, the tray 20 having a base 22 that defines a plurality of recesses 24 that are configured to receive a fluid 26. At least one duct 28 is disposed around the at least one slot 18 and is operably coupled to the evaporator 12. The at least one duct 28 directs the cool air from the evaporator 12 along the tray 20. At least one fan 30 is positioned at an acute angle 32 relative to the tray 20 and is selectively coupled to the housing 16 of the icemaker 14. The at least one fan 30 and the at least one duct 28 uniformly cool the tray 20.

Figure 2:
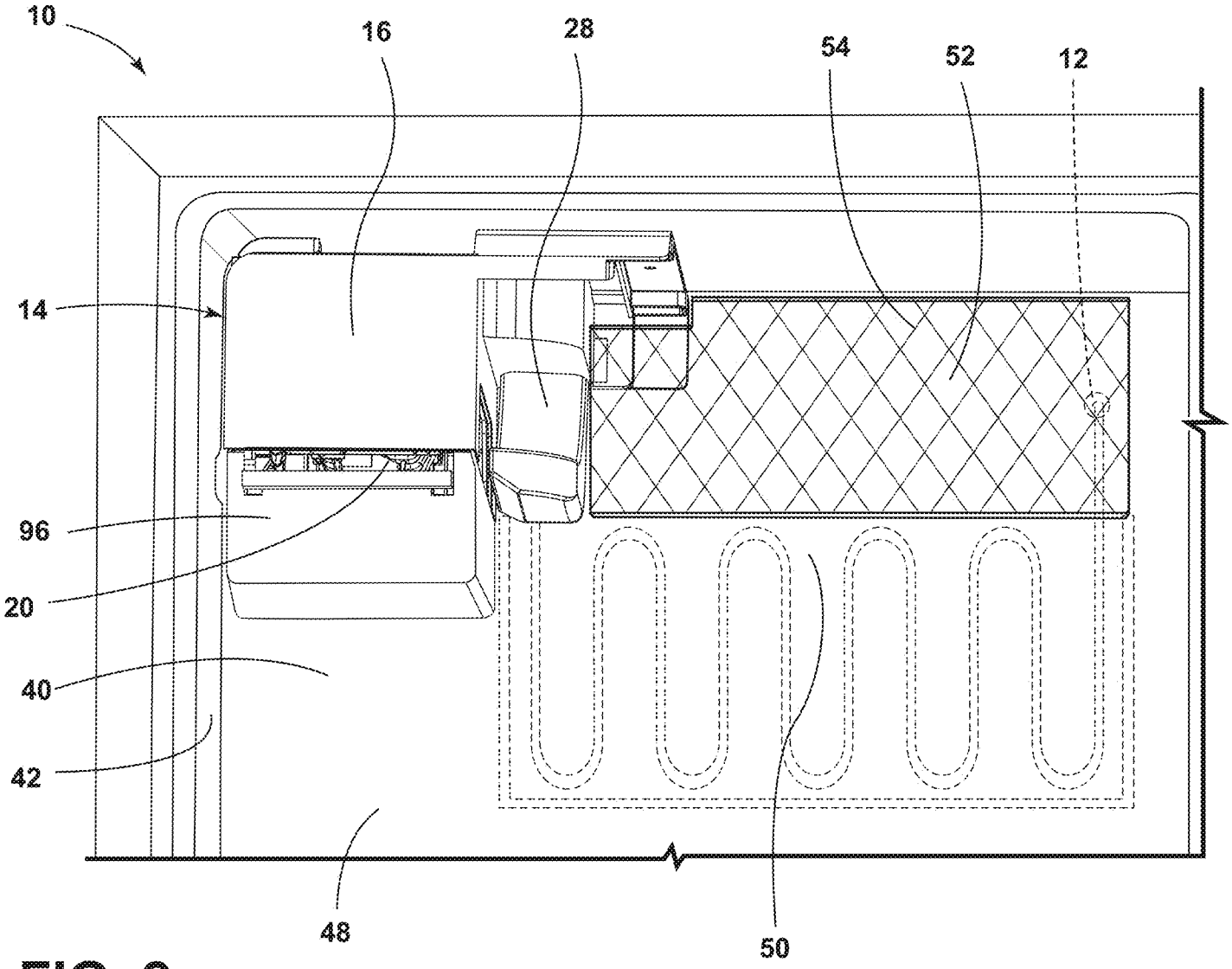
FIG. 2 is an enlarged partial front elevational view of the freezer compartment of FIG. 1 with an icemaker of the present disclosure.

Referring now to FIGS. 1-4, the refrigerating appliance 10 has a freezer compartment 40 and a refrigeration compartment 42 accessible via first and second doors 44, 46, respectively. While the refrigerating appliance 10 is illustrated with the freezer compartment 40 above the refrigeration compartment 42, it is also contemplated that the refrigerating appliance 10 may be a side-by-side appliance, a French door style appliance with a bottom-mounted drawer or any other appliance in which the icemaker 14 may be disposed. It is generally contemplated that the evaporator 12 of the refrigerating appliance 10 regulates an internal environment 48 of, at least, the freezer compartment 40. As illustrated in FIG. 2, a rear wall 50 of the freezer compartment 40 defines an outlet 52 through which the cool air from the evaporator 12 may be dispersed. A grate 54 may be positioned over the outlet 52 and coupled to the rear wall 50 of the freezer compartment 40. In general, cool air is dispersed from the evaporator 12 through the grate 54 and ultimately throughout the freezer compartment 40 to control the internal environment 48 of the freezer compartment 40. It is generally understood that the internal environment 48 of the freezer compartment 40 is sufficiently cool to keep items within the freezer compartment 40 frozen. Consequently, the fluid 26 deposited within the tray 20 transitions to ice at least partially as a result of the internal environment 48 of the freezer compartment 40. To expedite this transition, the icemaker 14 can be positioned within the freezer compartment 40 proximate the grate 54 and the evaporator 12.

Referring still to FIGS. 1-4, in addition to the housing 16 and the tray 20, the icemaker 14 includes a fluid dispenser 68 coupled to the housing 16, a motor 70 disposed within the housing 16, and a bail arm 72 coupled to the motor 70 proximate to the tray 20. Additionally, a sensor 74 is coupled to the base 22 of the tray 20 and is communicatively coupled to a controller 75, the motor 70, and a wire harness 76 disposed within the housing 16 of the icemaker 14. The wire harness 76 gathers wiring associated with the sensor 74 and the motor 70 into a single plug 77. The plug 77 of the wire harness 76 is coupled to the refrigerating appliance 10 (FIG. 1) to ultimately direct electrical power received by the refrigerating appliance 10 (FIG. 1) to the motor 70 and the sensor 74. The motor 70, as illustrated, also includes a power switch 78. The motor 70 may be activated and deactivated by the power switch 78 while remaining coupled to and receiving power from the refrigerating appliance 10 (FIG. 1).

Figure 5:
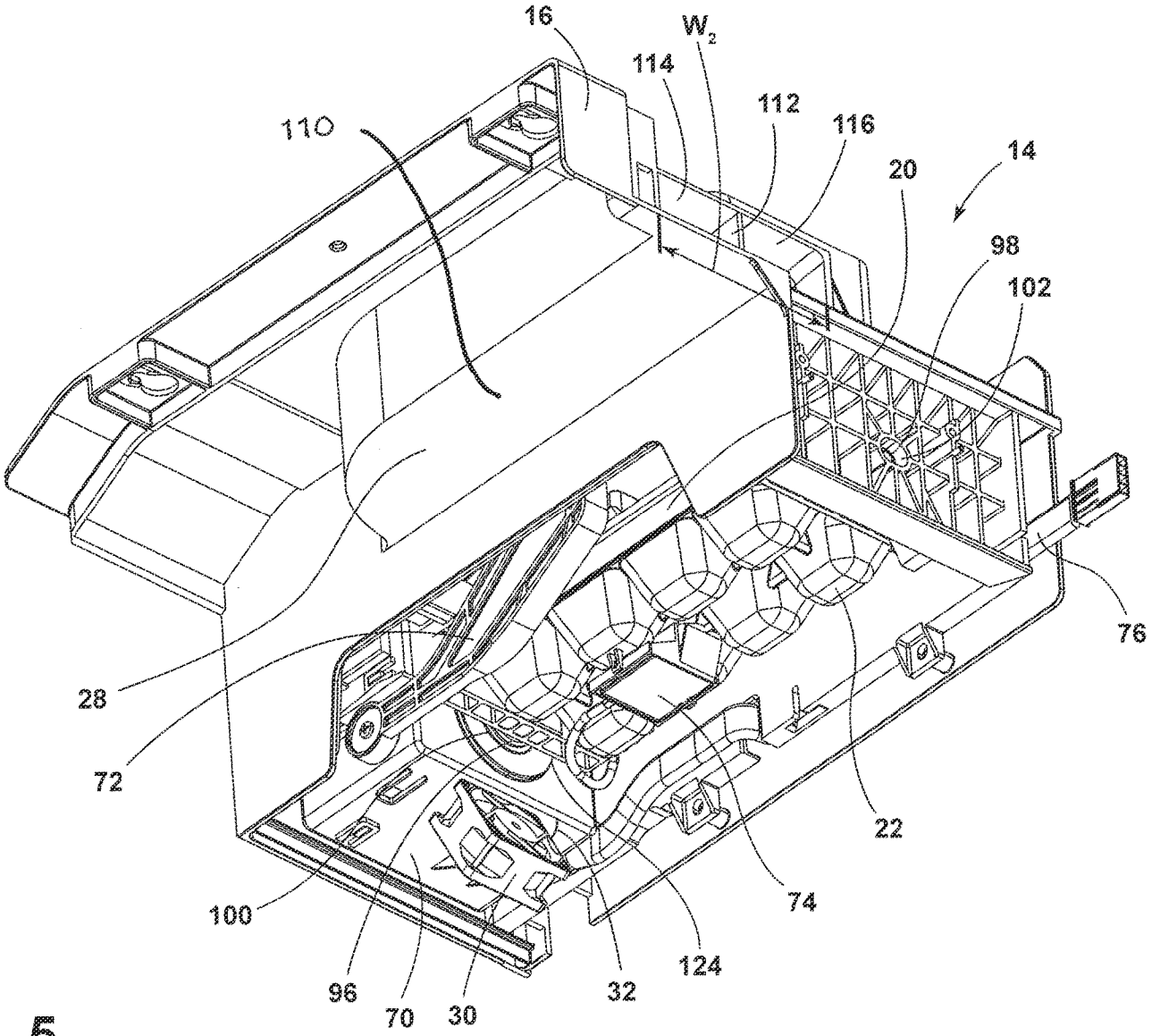
FIG. 5 is a bottom perspective view of the icemaker of FIG. 3 with a fan at an acute angle directed toward a base of the tray.
Figure 6:
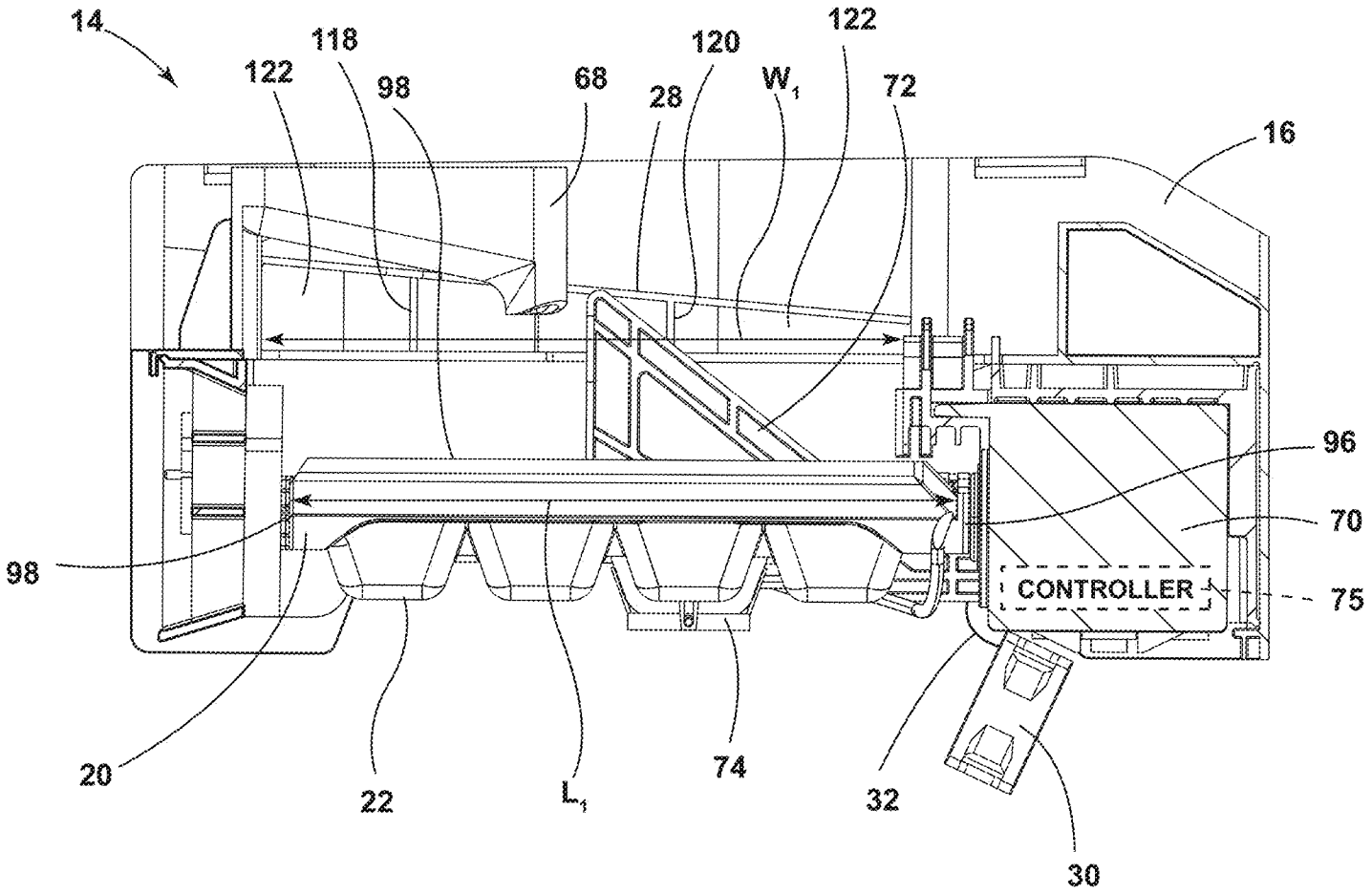
FIG. 6 is a cross-sectional view of the icemaker of FIG. 3 taken at line VI-VI with the tray in a receiving position.

Referring now to FIGS. 3-7, the tray 20 is operably coupled to the motor 70, such that the motor 70 rotates the tray 20 from a receiving position 92 (FIG. 5) to a depositing position 94 (FIG. 6). The tray 20 has first and second projections 96, 98 that rotatably couple the tray 20 to the housing 16. By way of example, not limitation, the first projection 96 is disposed within a first guiding aperture 100 that is defined by the motor 70, and the second projection 98 is disposed within a second guiding aperture 102 defined by the housing 16, as best illustrated in FIG. 8. Alternatively, the second projection 98 may be disposed within the first guiding aperture 100, and the first projection 96 may be disposed within the second guiding aperture 102. The motor 70 rotates the tray 20 via the first projection 96 within the first guiding aperture 100 to translate the tray 20 from the receiving position 92 into the depositing position 94, with the second projection 98 rotating in a similar manner within the second guiding aperture 102.

Once in the receiving position 92, the plurality of recesses 24 defined by the tray 20 receives the fluid 26 dispensed by the fluid dispenser 68, such that each of the plurality of recesses 24 are generally filled with the fluid 26. The fan 30 and the duct 28 partially form a cooling system for the icemaker 14, which uniformly cools and freezes the fluid 26 within the tray 20 to form ice, described in more detail below. The sensor 74 coupled to the base 22 of the tray 20 is configured to detect a threshold temperature of the tray 20. The threshold temperature of the tray 20 indicates the general temperature of the fluid 26 within the tray 20, which is sensed by the sensor 74. The sensor 74 communicates the gathered temperature data with the controller 75, and the controller 75, once the threshold temperature has been met, communicates with the motor 70 to rotate the tray 20 from the receiving position 92 to the depositing position 94. When the tray 20 is in the depositing position 94 the ice is dispensed from the tray 20 into a receiving bin 95, illustrated in FIG. 2. It is generally contemplated that the tray 20 may flex or bend slightly, such that as the tray 20 is rotated by the motor 70 the ice can be loosened within the tray 20 to be more easily removed from the tray 20 and deposited into the receiving bin 95 (FIG. 2).

Figure 3:
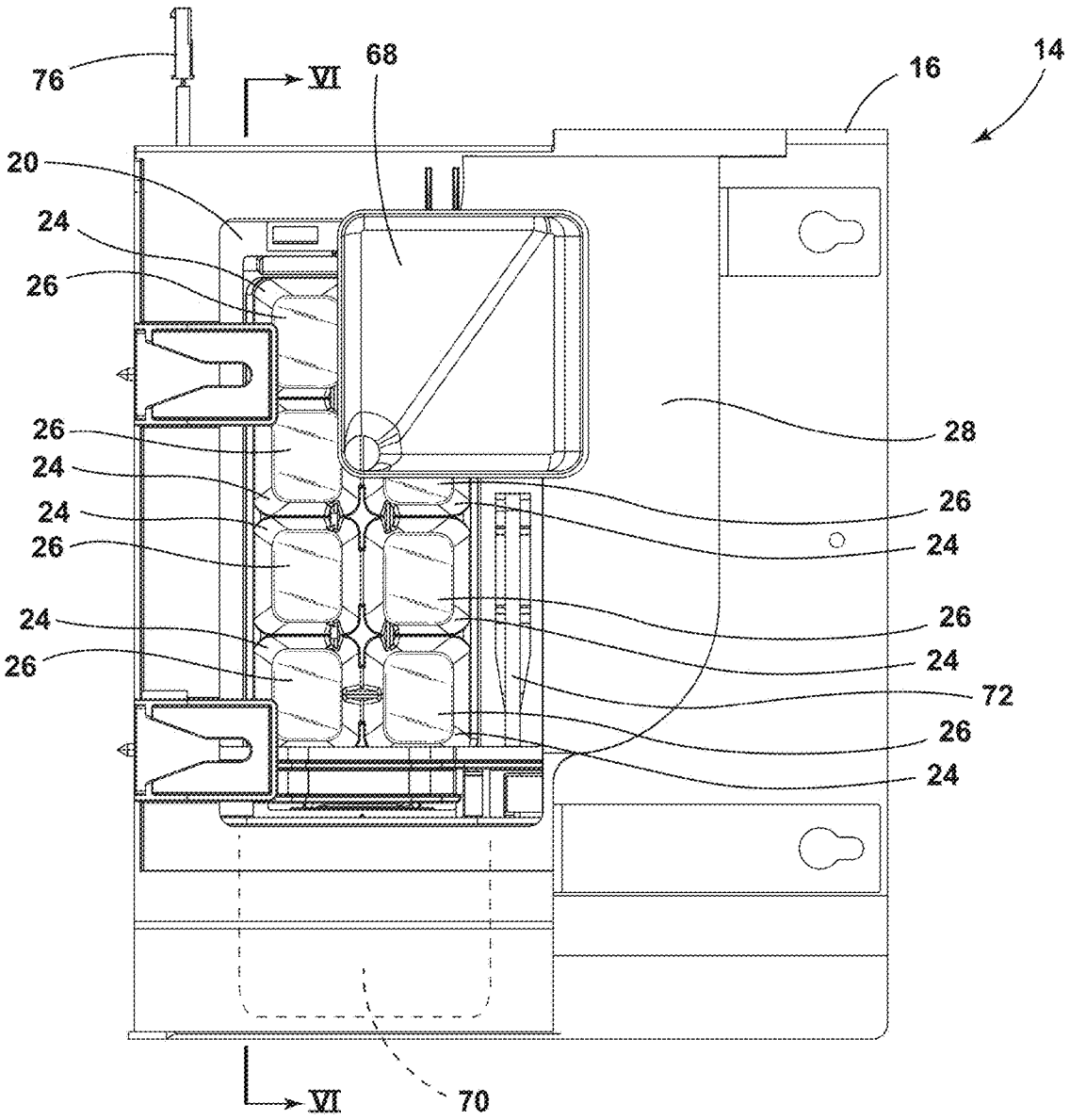
FIG. 3 is a top plan view of an icemaker of the present disclosure with a housing and a tray.
Figure 4:
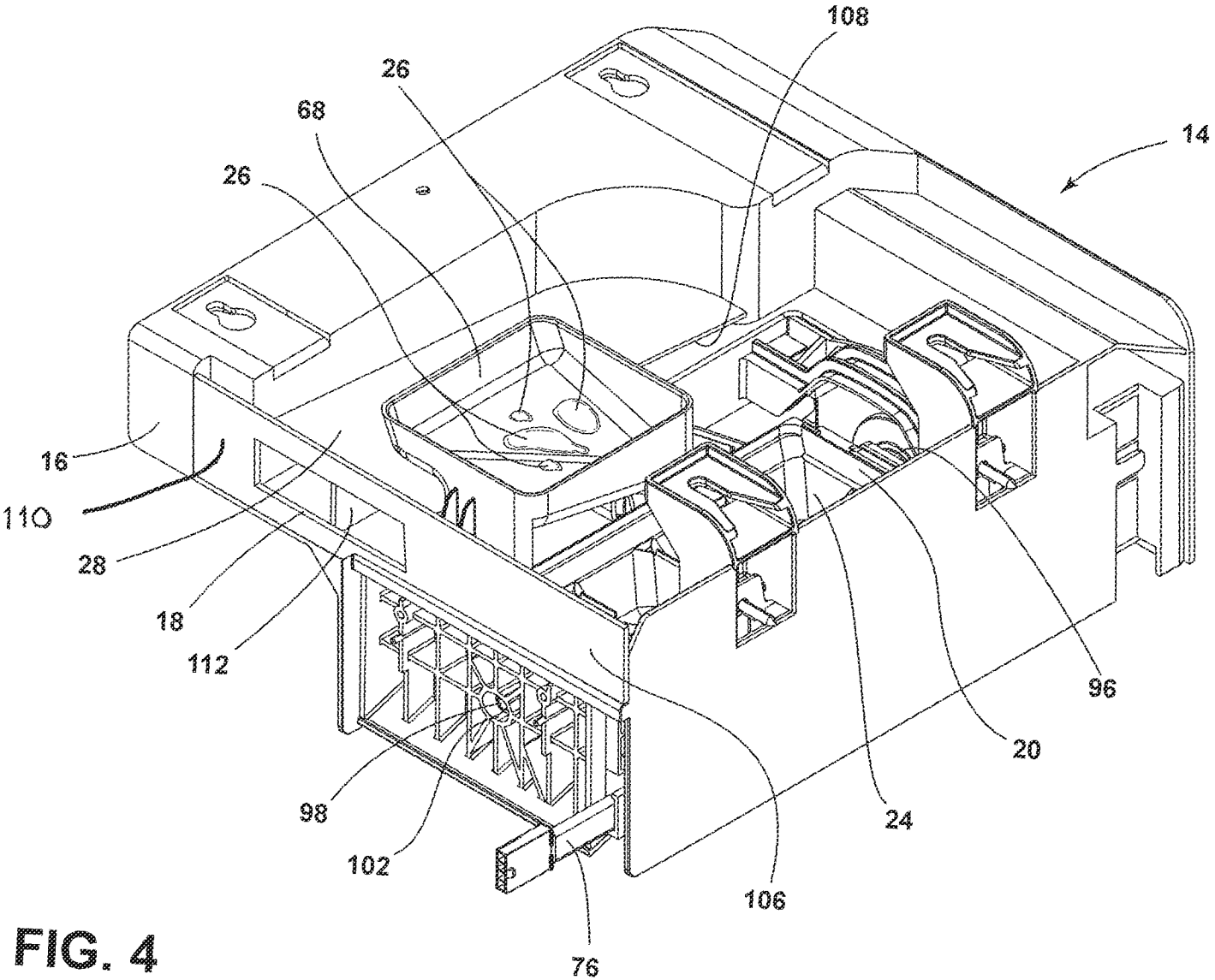
FIG. 4 is a top perspective view of the icemaker of FIG. 3 with a duct extending along a plurality of recesses defined by the tray.

Referring to FIGS. 2, 3, and 6, as the receiving bin 95 fills with ice, the bail arm 72 of the icemaker 14 is raised in response to an increase in ice within the receiving bin 95. Once the bail arm 72 is raised by the motor 70 to a predetermined level, the motor 70 of the icemaker 14 is temporarily deactivated by the controller 75 until the bail arm 72 transitions downward toward the receiving bin 95. Thus, the controller 75, in combination with the bail arm 72, regulates the amount of ice formed and dispensed within the receiving bin 95 in order to minimize the overproduction of ice by the icemaker 14, which ultimately saves energy. Additionally or alternatively, the power switch 78 of the motor 70 may be manually deactivated to regulate the ice production.

With further reference to FIGS. 3-7, the duct 28 extends along a length $L_1$ of the tray 20. The duct 28 is positioned proximate the plurality of recesses 24 defined by the tray 20 and is disposed around the slot 18 defined by the housing 16. The duct 28 is disposed in an upper portion 106 of the icemaker 14, such that the duct 28 is directed toward the plurality of recesses 24 of the tray 20. An opening 108 of the duct 28 has a width $W_1$ that is approximately equivalent to the length $L_1$ of the tray 20. Specifically, the width $W_1$ of the duct 28 is wider at the opening 108 defined proximate to the tray 20 than a width $W_2$ of the duct 28 where the duct 28 is coupled to the housing 16. In this construction, the duct 28 defines a generally tapered or funnel shape.

The duct 28 also has a generally arcuate outer casing 110 that extends from the housing 16 and is disposed around the slot 18, as mentioned above. The arcuate outer casing 110 is configured to redirect the cool air that enters the duct 28 from the slot 18 to more readily and evenly transmit the cool air from the evaporator 12 to the tray 20. The funnel shape and arcuate outer casing 110 of the duct 28 concentrate the cool air from the evaporator 12 before the cool air is applied to the tray 20. As the cool air is more concentrated within the duct 28, the cool air is generally applied to the tray 20 more quickly and forcefully. Stated differently, the funnel or tapered shape of the duct 28 moves the air entering the duct 28 quickly through the width $W_2$ proximate the housing 16 toward the opening 108 of the duct 28 with the width $W_1$. The width $W_1$ of the duct 28 ensures that a maximum amount of concentrated cool air is ultimately applied to the tray 20.

Figure 7:
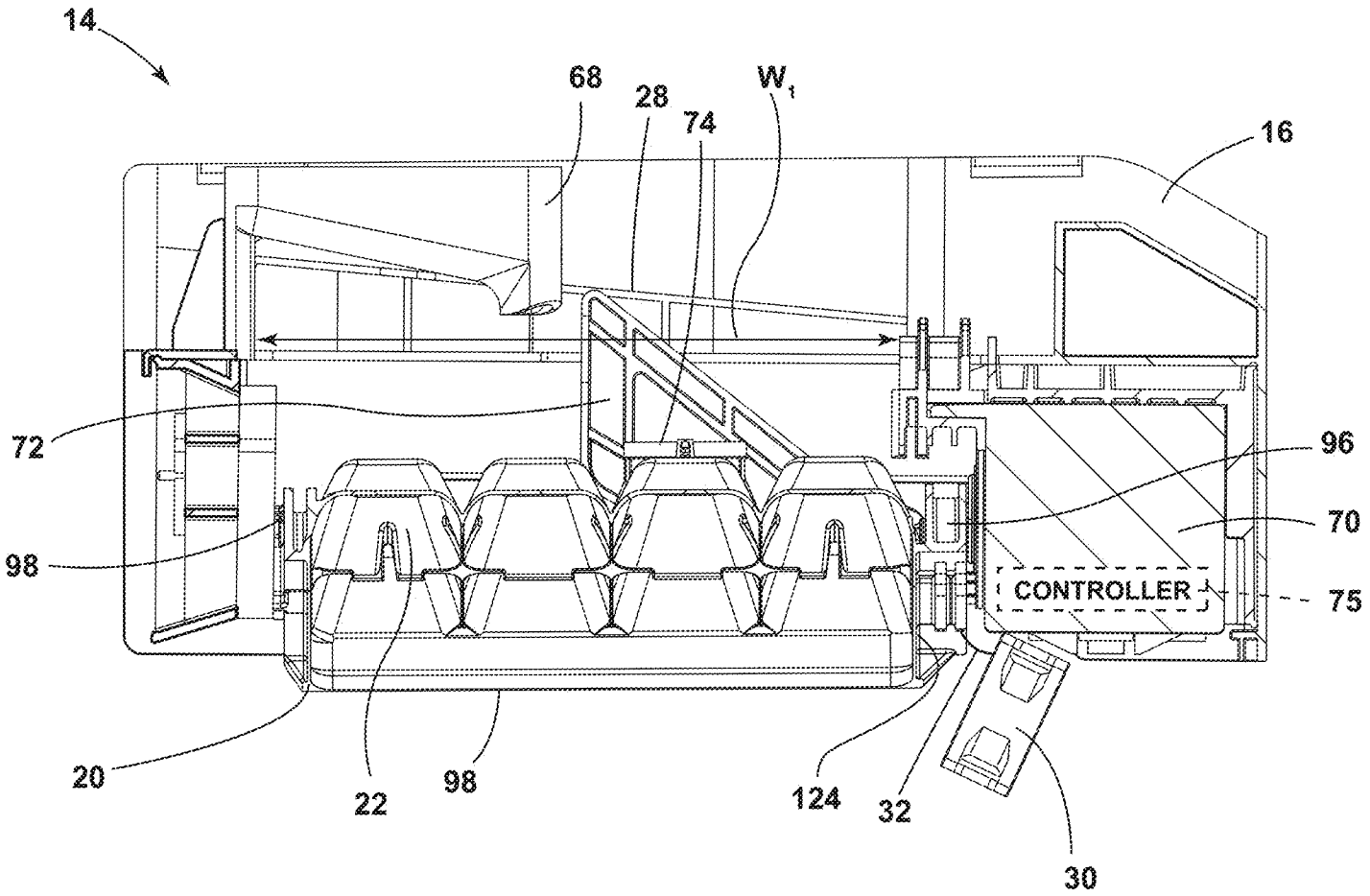
FIG. 7 is a cross-sectional view of the icemaker of FIG. 3 taken at line VI-VI with the tray in a depositing position.
Figure 8:
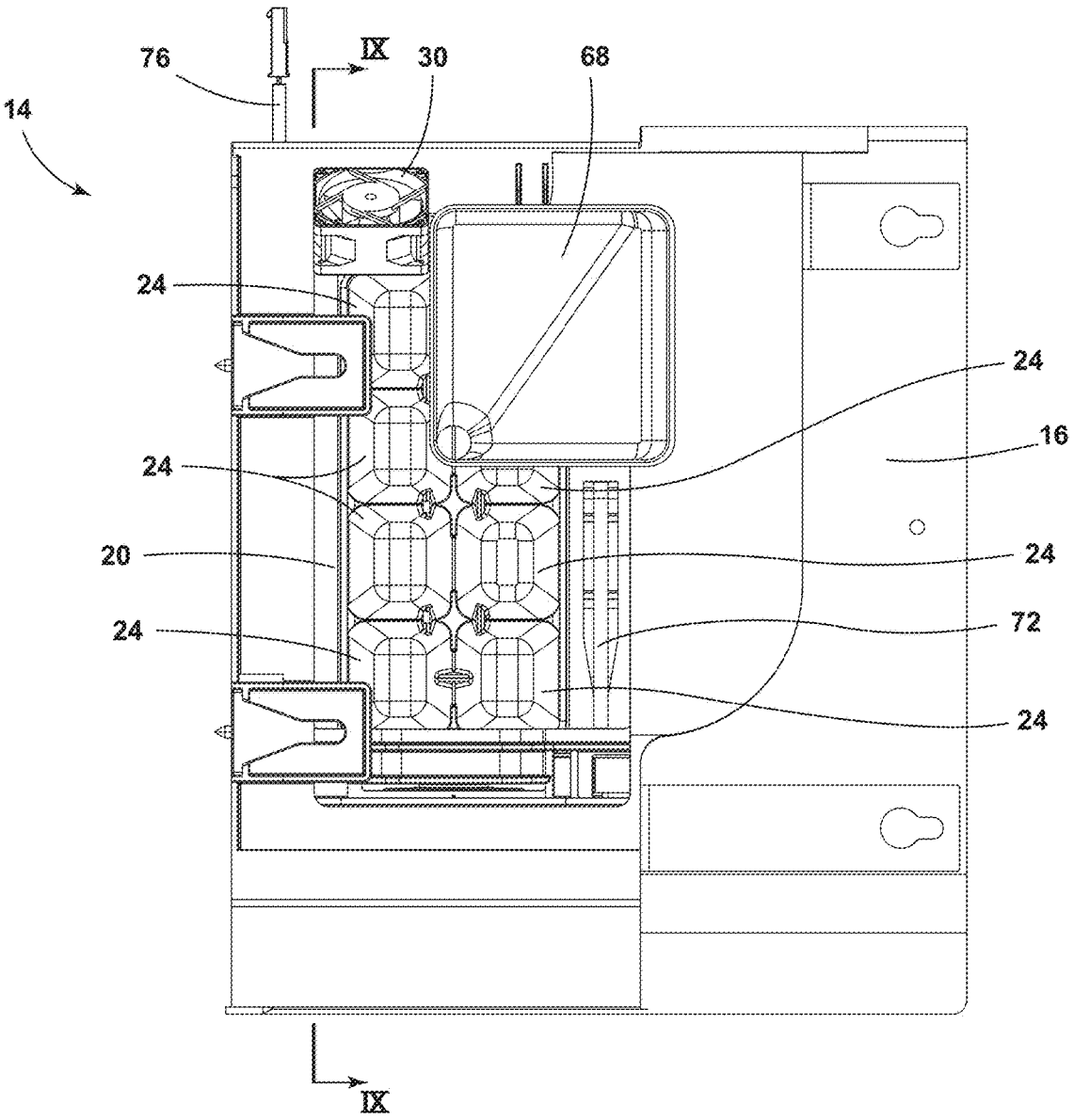
FIG. 8 is a top plan view of an icemaker of the present disclosure with a tray and a fan positioned at an angle directed toward the tray.

With further reference to FIGS. 5-7, the duct 28 can include a wall 112 centrally disposed within the duct 28 to generally define first and second channels 114, 116 of the duct 28. The wall 112 positioned within the duct 28 concentrates the air provided by the evaporator 12 within each of the first and second channels 114, 116, such that a more efficient and forceful delivery of the air across the tray 20 can be achieved. Additionally, or alternatively, the duct 28 may include a first wall 118 and a second wall 120, each defining an arcuate shape similar to the arcuate outer casing 110 positioned within the duct 28 to define a plurality of channels 122 within the duct 28. The plurality of channels 122 concentrates the cool air entering the duct 28 still further prior to directing the cool air along the tray 20. This targeted delivery of the cool air from the evaporator 12 along the tray 20 is particularly advantageous as it decreases the overall freezing time of the fluid 26 dispensed in the plurality of recesses 24 of the tray 20.

With the duct 28 positioned above the tray 20 in the upper portion 106 of the housing 16 the cool air passes over the plurality of recesses 24 defined by the tray 20. The width $W_1$ assists in maximum delivery of air to the tray 20 to rapidly and uniformly freeze the fluid 26 within the plurality of recesses 24 as mentioned above. While the duct 28 has the width $W_1$ at the opening 108 to ensure maximum application of the cool air, the duct 28 also can include the wall 112 to help maintain the concentration and coordinate the direction of the air as it is applied to the tray 20. The wall 112 further improves the uniformity of freezing because the air remains concentrated as it passes through the duct 28 and the first and second channels 114, 116 defined therein, as described above. Maintaining the concentration of the cool air within the duct 28 also results in a more forceful application of the cool air to the tray 20. The more forceful the cool air is applied to the tray 20 the quicker the fluid 26 within the tray 20 will transition into ice.

The freezing time is further decreased by the fan 30 positioned at the acute angle 32 relative to a planar extent 124 of the tray 20. The overall efficiency of the icemaker 14 is increased by reducing the freeze time of the fluid 26, which is a result of the duct 28 and the fan 30 providing a uniform and evenly distributed airflow to the tray 20. The efficiency is further improved by altering the number of ducts 28 and the number of fans 30, as will be described below.

Referring still to FIGS. 3-7, the fan 30 is coupled to a lower portion 130 of the housing 16. It is generally contemplated that the fan 30 is removably coupled to the housing 16, such that the fan 30 can be removed from the icemaker 14 for cleaning, adjustment, or other practical purposes. It is also contemplated that if the fan 30 is removed from one position within the housing 16, the fan 30 can be repositioned in a different position within the housing 16. For example, although depicted in the lower portion 130, the fan 30 may be repositioned in the upper portion 106, described below. As illustrated by FIG. 6, the fan 30 is in the lower portion 130 of the housing 16 and is angled toward the base 22 of the tray 20, while the duct 28 is disposed in the upper portion 106 of the housing 16 above the plurality of recesses 24 (FIG. 3). Thus, the tray 20 is being cooled from the top and the bottom simultaneously by the duct 28 and the fan 30, respectively.

As mentioned above, the fan 30 is disposed at the acute angle 32, such that the fan 30 is angled toward the base 22 of the tray 20 when in the lower portion 130 of the housing 16. The acute angle 32 of the fan 30 is generally defined as being between 0-degrees and 90-degrees. The acute angle 32 ensures that the fan 30 is uniformly circulating the cool air within the icemaker 14 toward and across the length $L_1$ of the tray 20. Moreover, the acute angle 32 minimizes the potential of frost build-up on the fan 30 as potential condensation can more easily run off as a result of the acute angle 32. By being positioned at the acute angle 32 the fan 30 can more directly and evenly apply the cool air to the entirety of the tray 20 as the cool air is being directed both across the tray 20 as well as upward and/or downward toward the tray 20 depending on the position of the fan 30 within the housing 16. The cool air circulated by the fan 30 is primarily the cool air present in the freezer compartment 40 (FIG. 2), which is provided by the evaporator 12 (FIG. 2). It is also contemplated that the cool air circulated by the fan 30 may be pulled from the cool air dispersed within the icemaker 14 by the duct 28. This circulation loop further decreases the freezing time of the fluid 26 within the tray 20, which ultimately increases the overall efficiency of the icemaker 14.

Figure 9:
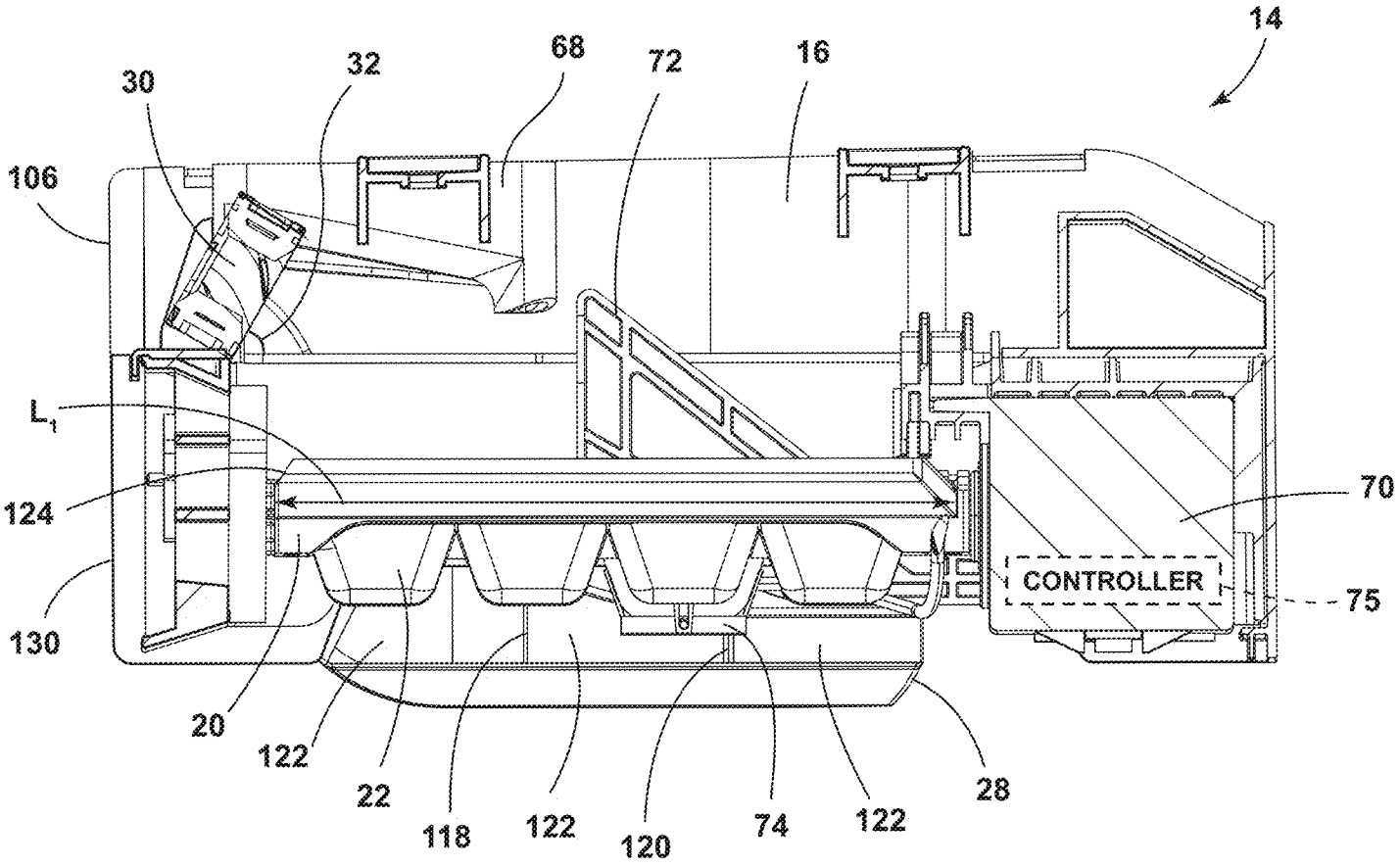
FIG. 9 is a cross-sectional view of the icemaker of FIG. 8 taken at line IX-IX with the fan directed toward a top of the tray and a duct extending along a base of the tray.
Figure 10:
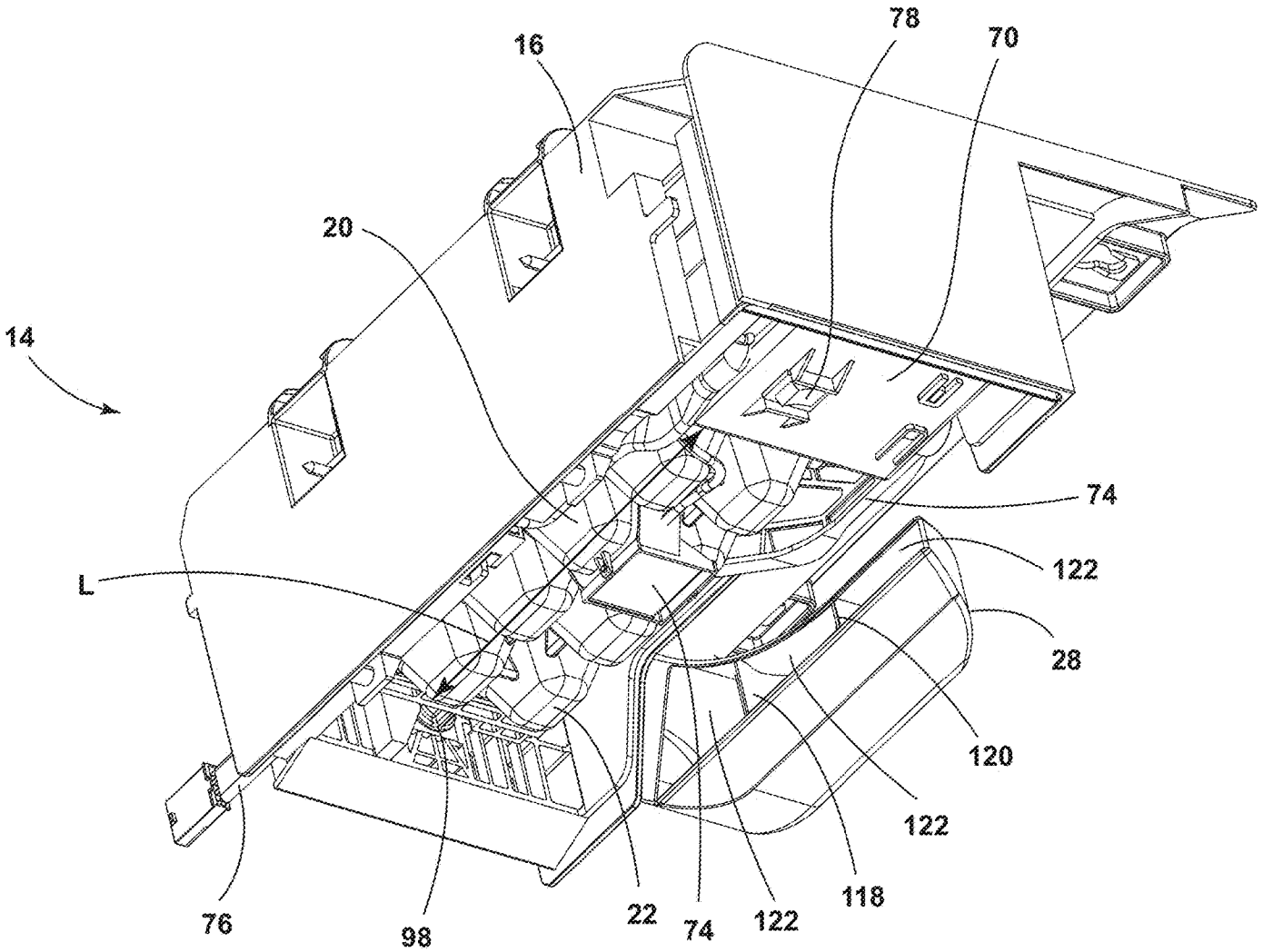
FIG. 10 is a bottom perspective view of the icemaker of FIG. 8 with the duct extending along a length of the base of the tray.

Referring now to FIGS. 8-10, while the duct 28 may be positioned in the upper portion 106 of the housing 16 (FIG. 4), it is also contemplated that the duct 28 may be positioned in a lower portion 130 of the housing 16. When positioned in the lower portion 130, the duct 28 is generally positioned proximate the base 22 of the tray 20, such that the duct 28 directs the cool air toward the base 22 of the tray 20. As a result, the fluid 26 within the tray 20 is cooled by the duct 28 both from beneath and from a side of the tray 20, rather than above the tray 20. In this configuration, the duct 28 can still also include the wall 112 and/or the first and second walls 118, 120, generally described above, to further concentrate the cool air being directed at the base 22 of the tray 20. The same general principle described above in relation to positioning the duct 28 in the upper portion 106 of the housing 16 applies to the positioning of the duct 28 in the lower portion 130. The overall result of either position of the duct 28 within the icemaker 14 is the improved and increased efficiency of the icemaker 14 by, in combination with the fan 30, rapidly freezing the fluid 26 disposed within the tray 20.

As mentioned above, the fan 30 can be positioned in and coupled to the upper portion 106 of the housing 16. In this configuration, depicted in FIGS. 8-10, the fan 30 is positioned at the acute angle 32 directed toward the plurality of recesses 24, and the duct 28 is disposed in the lower portion 130 of the housing 16 proximate the base 22 of the tray 20. In the upper portion 106 of the housing 16, the fan 30 is still positioned at the acute angle 32 between 0-degrees and 90-degrees, and is directed toward the plurality of recesses 24, as illustrated in FIGS. 8 and 9. The acute angle 32 of the fan 30 allows the cool air to more directly spread across the plurality of recesses 24 as the fan 30 is directed toward the plurality of recesses 24, rather than targeting a specific portion of the tray 20.

Figure 11:
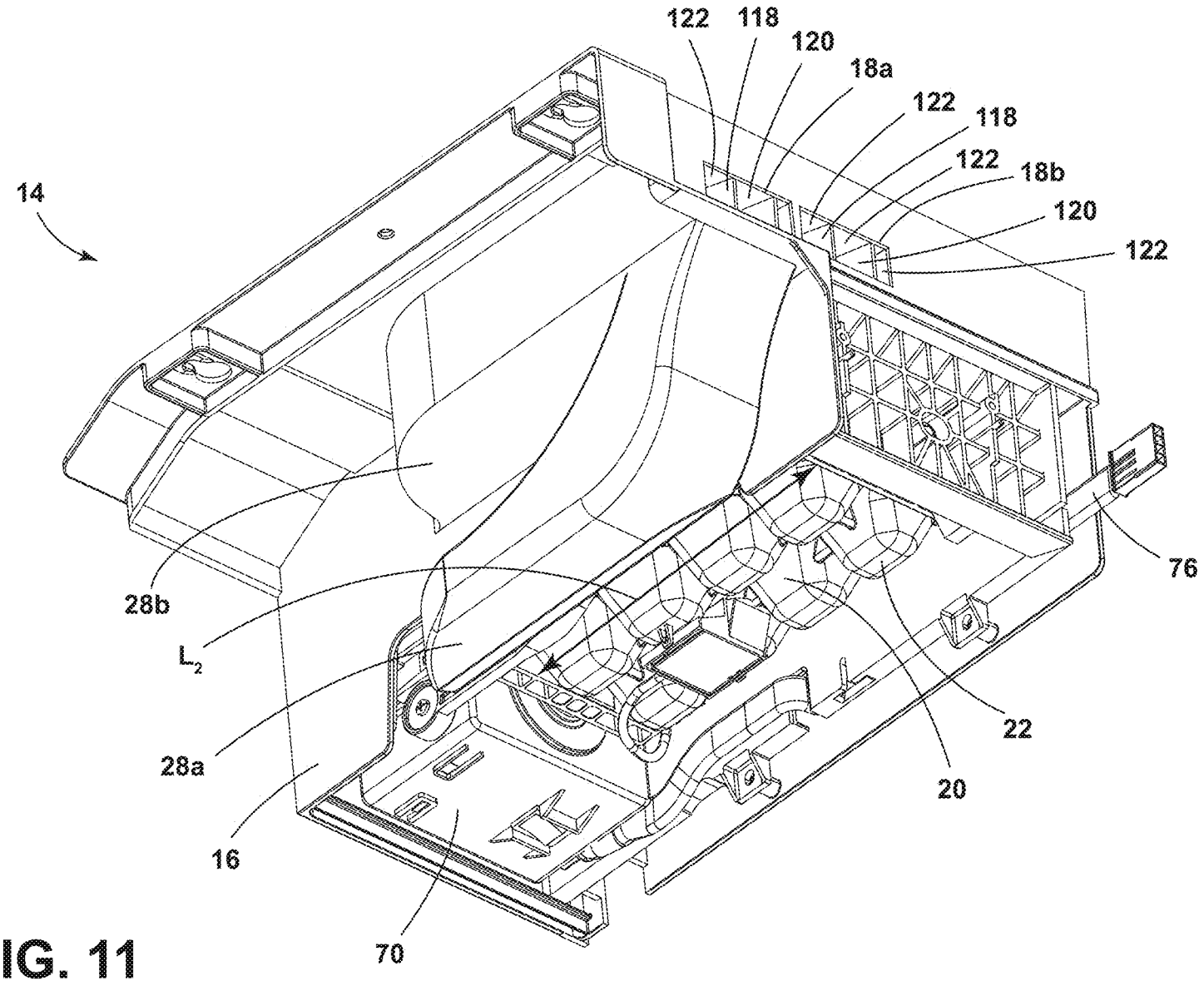
FIG. 11 is a bottom perspective view of an icemaker of the present disclosure that has a first duct and a second duct.
Figure 12:
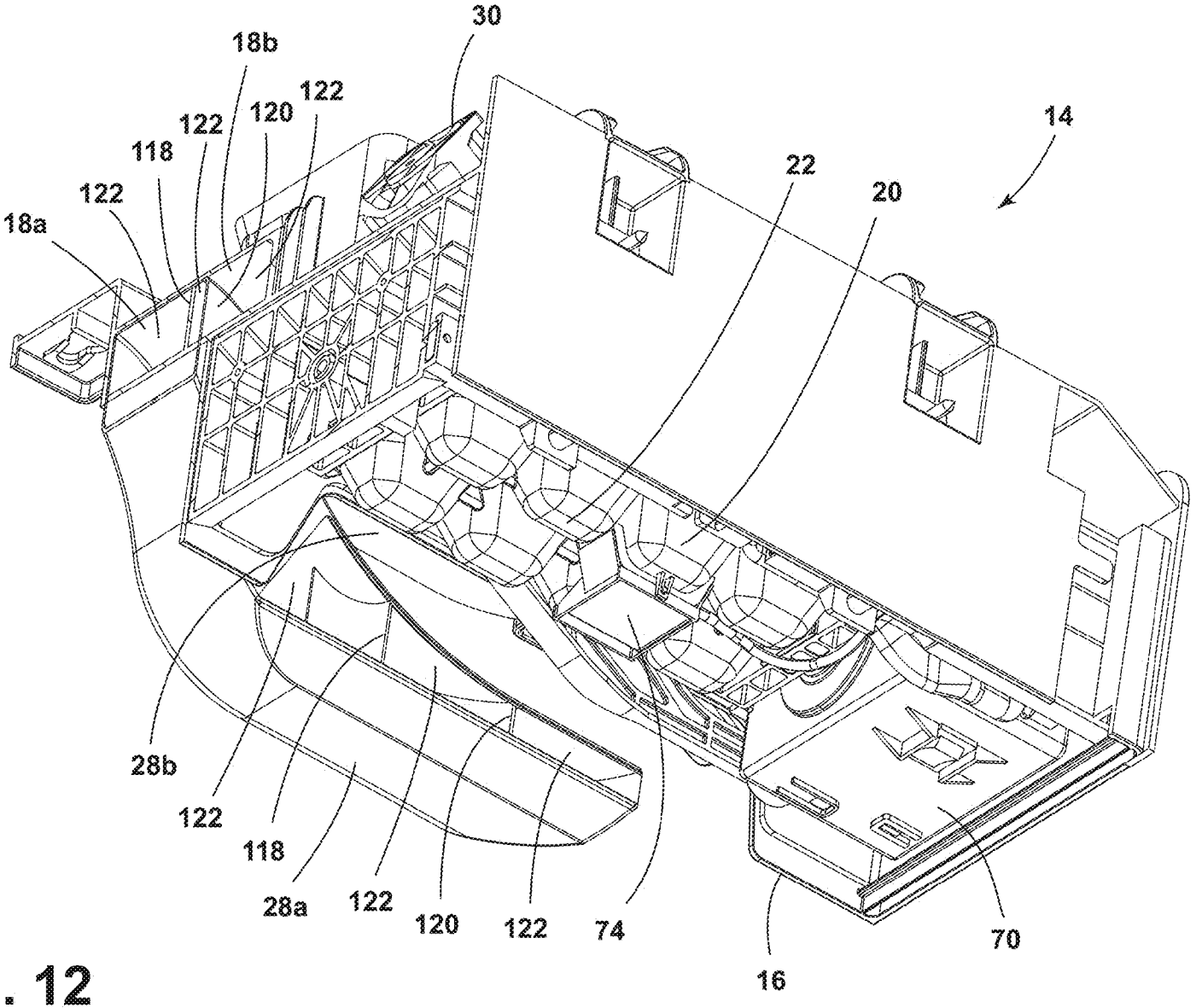
FIG. 12 is a bottom perspective view of the icemaker of FIG. 11.
Figure 13:
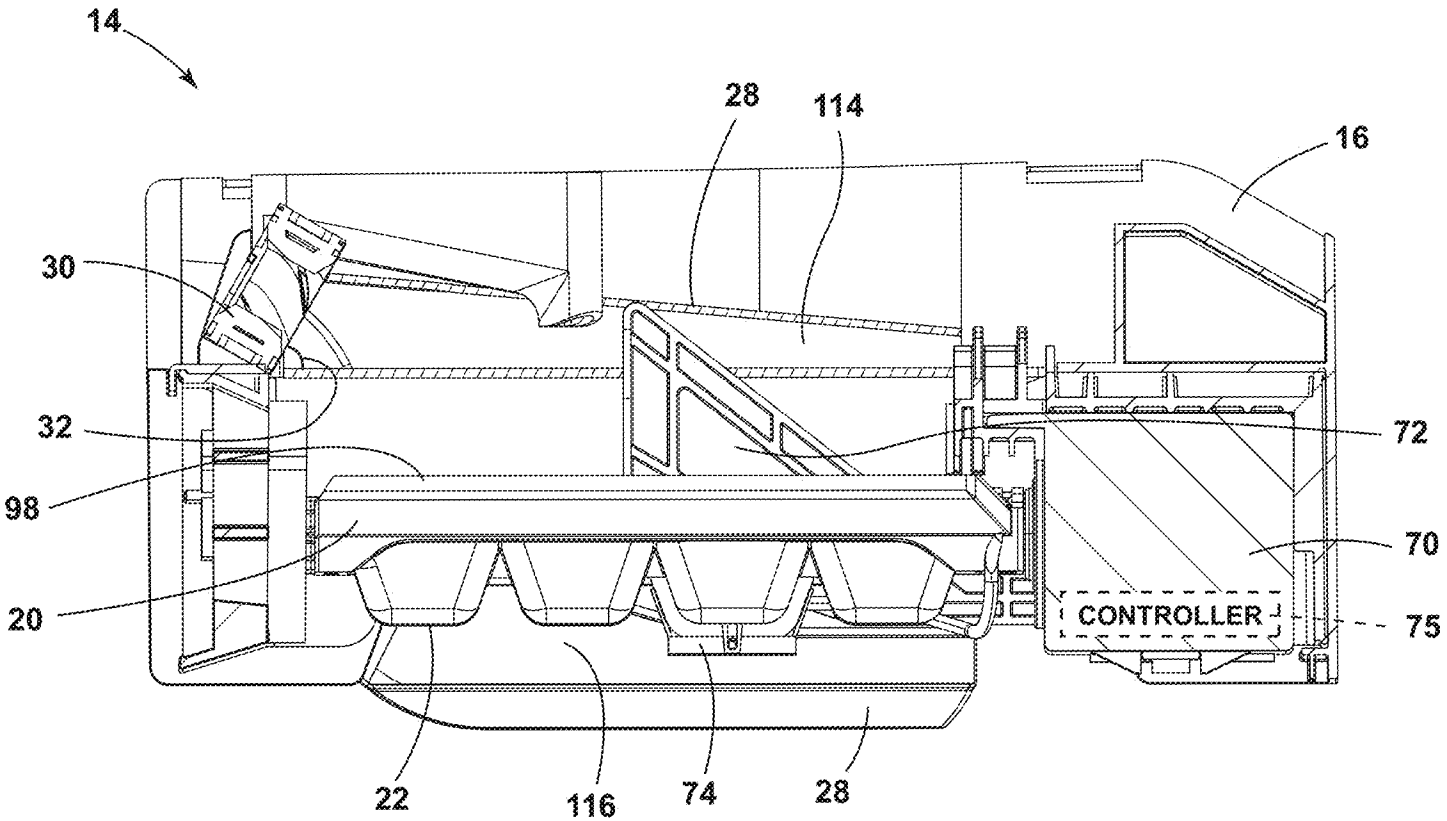
FIG. 13 is a cross-sectional view of an icemaker of the present disclosure with a duct defining a first channel and a second channel.

With reference now to FIGS. 11-13, it is generally contemplated that the duct 28 can include a first duct **28*a* and a second duct 28*b*, each operably coupled to the evaporator 12. Moreover, it is also contemplated that the slot 18 defined by the housing 16 may include a first slot 18***a* and a second slot 18*b*, respectively surrounded by the first duct 28*a* and the second duct 28*b*. While the second duct 28*b* is generally disposed around the second slot 18*b*, it is also contemplated that the second duct 28*a* may extend around both the first and second slots 18*a*, 18*b*. As illustrated in FIGS. 11 and 12, the first duct 28*a* is positioned in the lower portion 130 of the housing 16 and the second duct 28*b* is positioned in the upper portion 106 of the housing 16. The first duct 28*a* is depicted as extending along a length L2 of the base 22, and the second duct 28*b* is depicted as extending along the plurality of recesses 24 (FIG. 8). By incorporating both the first and second ducts 28*a*, 28*b* the entirety of the tray 20 can receive the concentrated cool air from the evaporator 12. Specifically, the first duct 28*a* concentrates the cool air to target the base 22 of the tray 20, and the second duct 28*b* concentrates the cool air to target the tray 20 along the plurality of recesses 24. Thus, the incorporation of the first and second ducts 28*a*, 28*b* further decreases the freezing time of the fluid 26, which increases the overall efficiency of the icemaker 14. This efficiency is improved still further by the addition of the fan 30.

Additionally or alternatively, the duct 28 can be split into the first channel 114 and the second channel 116, as illustrated in FIG. 13, with the first channel 114 disposed proximate to the plurality of recesses 24 (FIG. 8), and the second channel 116 extending along the base 22 of the tray 20. This construction has the first channel 114 of the duct 28 disposed within the upper portion 106 of the housing 16, and the second channel 116 of the duct 28 disposed within the lower portion 130 of the housing 16.

Figure 14:
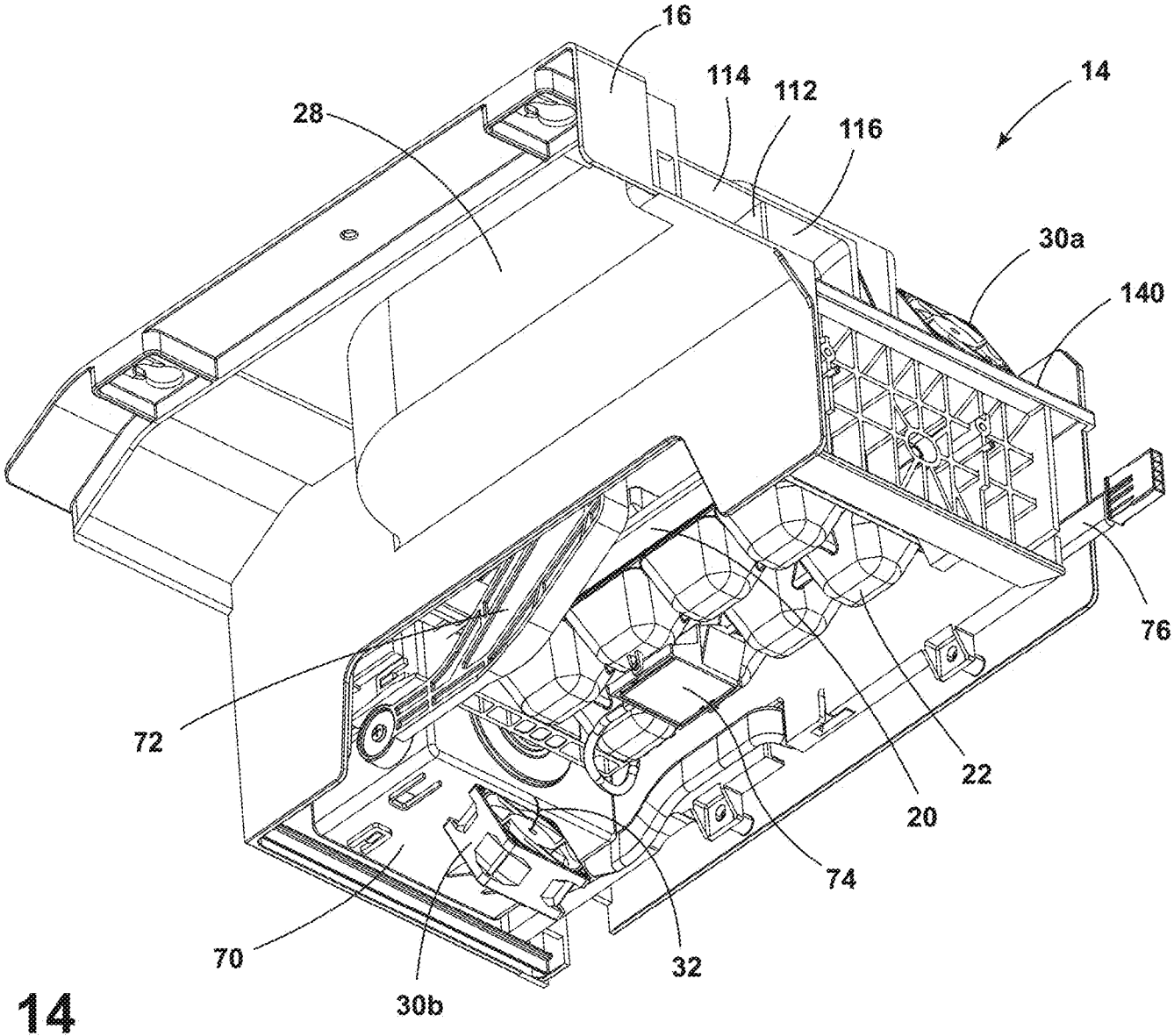
FIG. 14 is a bottom perspective view of an icemaker of the present disclosure that has a first fan and a second fan.

Referring now to FIG. 14, the fan 30 can include a first fan 30*a* and a second fan 30*b*, each positioned at the acute angle 32 relative to the tray 20 and selectively coupled to the housing 16 of the icemaker 14. Both the first and second fans 30*a*, 30*b* can be incorporated in the icemaker 14 in addition to the duct 28. As illustrated in FIG. 14, the first fan 30*a* is coupled to the housing 16 in the upper portion 106 of the housing 16, and the second fan 30*b* is coupled to the housing 16 in the lower portion 130 of the housing 16. In addition, the duct 28 may be positioned in either the upper portion 106 and/or the lower portion 130 of the housing 16. This configuration provides the concentrated cool airflow from the duct 28, in any one of the configurations described above, while also providing increased circulation and directed application of cool air to the tray 20 from both the first fan 30*a* and the second fan 30*b*.

The first fan 30*a* can be coupled to a first end 140 of the housing 16 proximate the fluid dispenser 68 while the second fan 30*b* can be coupled to the housing 16 proximate the motor 70. Thus, in addition to the first fan 30*a* being directed toward the plurality of recesses 24 and the second fan 30*b* being directed toward the base 22 of the tray 20, but the first and second fans 30*a*, 30*b* also direct the cool air from opposite ends of the tray 20 as well. This dual-direction of air by the first and second fans 30*a*, 30*b* results in an even and uniform cooling of the fluid 26 as an even or uniform amount of cool air is being applied to the tray 20 from both the top and the bottom as well as either end of the tray 20. As the duct 28 is also positioned within the housing 16 either proximate the plurality of recesses 24 or proximate the base 22 of the tray 20, the tray 20 is receiving concentrated cool air from the duct 28 in addition to the first and second fans 30*a*, 30*b*.

With reference to FIGS. 11 and 14, it is further contemplated that in combination with the first and second fans 30*a*, 30*b* the icemaker 14 may also include both of the first and second ducts 28*a*, 28*b*. This configuration of the icemaker 14 with both the first and second fans 30*a*, 30*b* and the first and second ducts 28*a*, 28*b* provides a further increase in cooling efficiency for forming ice within the tray 20. With specific reference to the first and second fans 30*a*, 30*b*, it is contemplated that both the first and second fans 30*a*, 30*b* may be positioned in either the upper portion 106 and/or the lower portion 130 of the housing 16. For example, the first and second fans 30*a*, 30*b* can be positioned next to one another above the motor 70 and directed toward the plurality of recesses 24. While this is one contemplated configuration of the first and second fans 30*a*, 30*b*, other configurations are contemplated including, but not limited to, both of the first and second fans 30*a*, 30*b* being positioned within the lower portion 130 of the housing 16.

Furthermore, in such configuration, the first and second ducts 28*a*, 28*b* may be positioned, as described above, in both the upper portion 106 and the lower portion 130 of the housing 16 in addition to the first and second fans 30*a*, 30*b*. It is also contemplated that the first and second ducts 28*a*, 28*b* can be positioned side by side, such that the first and second ducts 28*a*, 28*b* are separate but adjacent to one another. This configuration, as well as the other configurations described herein, results in the cool air from the evaporator 12 being concentrated and directly applied to the tray 20, whether from above the tray 20 or below the tray 20. Ultimately, the combination of the first and second fans 30*a*, 30*b* and the first and second ducts 28*a*, 28*b* improves the overall efficiency of the icemaker 14 to quickly produce ice from the fluid 26 deposited within the tray 20.

Specifically, the combination of dual first and second ducts 28*a*, 28*b* and dual first and second fans 30*a*, 30*b* circulates the cool air from the evaporator 12 to rapidly transition the fluid 26 into ice. The quicker the fluid 26 can transition into ice the more energy will be saved by the entire system.

The invention disclosed herein is further summarized in the following paragraphs and is further characterized by combinations of any and all of the various aspects described therein.

According to one aspect of the present disclosure, a refrigerating appliance includes an evaporator that is configured to output cool air into the refrigerating appliance. An icemaker is fluidly coupled to the evaporator. The icemaker includes a housing that defines at least one slot. A tray is operably coupled to the housing. The tray has a base and defines a plurality of recesses configured to receive a fluid. At least one duct is disposed around the at least one slot and is operably coupled to the evaporator. The at least one duct is configured to direct the cool air from the evaporator along the tray. At least one fan is positioned at an acute angle relative to the tray and is selectively coupled to the housing of the icemaker. The at least one fan and the at least one duct uniformly cool the tray.

According to another aspect, at least one duct includes a first duct and a second duct. The first duct extends along a length of a base of a tray and the second duct extends along a plurality of recesses defined by the tray.

According to yet another aspect, at least one slot includes a first slot and a second slot. A first duct is disposed around the first slot and a second duct is disposed around the second slot.

According to still another aspect, a first duct and a second duct each includes a wall that is configured to direct cool air within each of the first duct and the second duct.

According to another aspect, a first duct and a second duct each have a first wall and a second wall. The first wall and the second wall define a plurality of channels that are configured to direct cool air from an evaporator along a tray.

According to another aspect, at least one fan includes a first fan directed toward a plurality of recesses defined by a tray. A second fan is directed toward a base of the tray at an angle between 0-degrees and 90-degrees relative to the tray.

According to still another aspect, at least one duct includes a first wall and a second wall. The first wall and the second wall each direct cool air within the at least one duct along a tray.

According to another aspect of the present disclosure, a cooling system for an icemaker includes an evaporator that is configured to output cool air. A duct is coupled to the evaporator and is configured to redirect the cool air from the evaporator to the icemaker. A tray has a base and defines a plurality of recesses configured to receive a fluid. At least one fan is directed toward a plurality of recesses of the tray at an angle between 0-degrees and 90-degrees relative to the tray. The at least one fan and the duct uniformly freeze the fluid received by the plurality of recesses.

According to another aspect, a duct extends along a base of a tray.

According to still another aspect, a duct includes a first wall and a second wall that uniformly direct cool air from an evaporator along a tray.

According to yet another aspect, a first wall and a second wall are each arcuate and define a plurality of channels within a duct that uniformly direct cool air from a freezing evaporator along a tray.

According to another aspect, a duct includes a first channel and a second channel. A first channel is disposed proximate to a plurality of recesses defined by a tray and the second channel extends along a base of the tray.

According to still another aspect, at least one fan includes a first fan that is angled toward a base of a tray and a second fan that is angled toward a plurality of recesses.

According to yet another aspect, a duct includes a wall that is disposed within a duct to define a first channel and a second channel. The first channel and the second channel uniformly direct cool air from an evaporator along a tray.

According to yet another aspect of the present disclosure, an icemaker assembly includes a housing that defines a slot. A tray is operably coupled to the housing and defines a plurality of recesses. A duct is coupled to the housing and is disposed around the slot. The duct directs cool air along the tray. A fan is operably coupled to the housing at an acute angle relative to a planar extent of the tray. The fan and the duct evenly distribute the cool air along the tray.

According to another aspect, a duct extends along a length of a tray proximate a plurality of recesses.

According to yet another aspect, a fan is directed toward a base of a tray at an acute angle.

According to still another aspect, a duct includes a first channel and a second channel. The first channel is disposed proximate to a plurality of recesses defined by a tray and the second channel extends along a base of the tray.

According to another aspect, a first channel and a second channel each include a first wall and a second wall. The first wall and the second wall direct cool air within each of the first channel and the second channel uniformly along a tray.

According to another aspect, a controller is communicatively coupled to a tray. A sensor is coupled to a base of the tray and is communicatively coupled to the controller. The sensor is configured to detect a threshold temperature of the tray.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A refrigerating appliance, comprising:

an evaporator configured to output cool air into at least a freezer compartment of the refrigerating appliance; and an icemaker fluidly coupled to the evaporator, the icemaker comprising:

a housing that defines at least one slot;

a tray operably coupled to the housing, the tray having a bottom base, a top defining a plurality of recesses configured to receive a fluid, and two opposed ends;

at least one duct disposed around the at least one slot and operably coupled to the evaporator by which the icemaker is fluidly coupled with the evaporator, wherein the evaporator is disposed outside the housing and outside of the at least one duct, and the at least one duct is configured to direct the cool air from the evaporator into the housing and along the tray; and a first fan and a second fan each positioned outside of the at least one duct and each positioned at an acute angle relative to and proximate the tray and selectively coupled to the housing of the icemaker, whereby the first fan, the second fan, and the at least one duct uniformly cool the tray by directing the cool air to the tray;

wherein the first fan is angled toward and directs the cool air to the bottom base of the tray and the second fan is angled toward and directs the cool air to the plurality of recesses, and the first fan and the second fan direct the cool air from the opposed ends of the tray, respectively.

2. The refrigerating appliance of claim 1, wherein the at least one duct includes a first duct and a second duct, the first duct extending along a length of the base of the tray and the second duct extending along the plurality of recesses defined by the tray.

3. The refrigerating appliance of claim 2, wherein the at least one slot includes a first slot and a second slot, and wherein the first duct is disposed around the first slot and the second duct is disposed around the second slot.

4. The refrigerating appliance of claim 2, wherein the first duct and the second duct each include a wall configured to direct the cool air within each of the first duct and the second duct.

5. The refrigerating appliance of claim 1, wherein the at least one duct has a first wall and a second wall, the first wall and the second wall defining a plurality of channels within the at least one duct configured to direct the cool air from the evaporator along the tray.

6. The refrigerating appliance of claim 1, wherein each of the first fan and the second fan are directed toward the tray at a first acute angle and a second acute angle, respectively, the first acute angle and the second acute angle being between 0-degrees and 90-degrees relative to the tray.

7. The refrigerating appliance of claim 1, wherein the at least one duct includes a first wall and a second wall, the first wall and the second wall each direct the cool air within the at least one duct along the tray.

8. A cooling system for an icemaker, comprising:

a housing;

an evaporator disposed outside of the housing and configured to output cool air into at least a freezer compartment of a refrigerating appliance and the housing;

a duct coupled to the evaporator and configured to redirect the cool air from the evaporator to said icemaker disposed within the housing, wherein the evaporator is disposed outside of the duct;

a tray having a bottom base, a top defining a plurality of recesses configured to receive a fluid, and two opposed ends; and a first fan and a second fan positioned outside of the duct and each directed toward the plurality of recesses of the tray at an acute angle between 0-degrees and 90-degrees relative to a planar extent of the tray, wherein the first fan and the second fan are disposed proximate the tray, and whereby the whereby the first fan, the second fan, and the duct uniformly freeze the fluid received by the plurality of recesses;

wherein the first fan is angled toward and directs the cool air to the base of the tray and the second fan is angled toward and directs the cool air to the plurality of recesses, and the first fan and the second fan direct the cool air from the opposed ends of the tray, respectively.

9. The cooling system of claim 8, wherein the duct extends along the base of the tray.

10. The cooling system of claim 8, wherein the duct includes a first wall and a second wall that uniformly direct the cool air from the evaporator along the tray.

11. The cooling system of claim 10, wherein the first wall and the second wall are each arcuate and define a plurality of channels within the duct that uniformly direct the cool air from the freezing evaporator along the tray.

12. The cooling system of claim 8, wherein the duct includes a first channel and a second channel, the first channel disposed proximate to the plurality of recesses defined by the tray and the second channel extending along the base of the tray.

13. The cooling system of claim 8, wherein the duct includes a wall disposed within the duct to define a first channel and a second channel, the first channel and the second channel uniformly direct the cool air from the evaporator along the tray.

14. An icemaker assembly, comprising:

a housing that defines a slot;

a tray operably coupled to the housing, the tray comprising a bottom base, a top defining a plurality of recesses, and two opposed ends;

a duct coupled to the housing and disposed around the slot, the duct directing cool air along the tray from an evaporator, wherein the evaporator is disposed outside of the housing and the duct and also provides the cool air to at least a freezer compartment of a refrigeration appliance and the housing of the icemaker; and a first fan and a second fan positioned outside of the duct and operably coupled to the housing at an acute angle relative to and proximate a planar extent of the tray, whereby the first fan, the second fan, and the duct evenly distribute the cool air along the tray by directing the cool air to the tray;

wherein the first fan is angled toward and directs the cool air to the bottom base of the tray and the second fan is angled toward and directs the cool air to the plurality of recesses, and the first fan and the second fan direct the cool air from the opposed ends of the tray, respectively.

15. The icemaker assembly of claim 14, wherein the duct extends along a length of the tray proximate the plurality of recesses.

16. The icemaker assembly of claim 14, wherein the duct includes a first channel and a second channel, the first channel disposed proximate to the plurality of recesses defined by the tray and the second channel extending along a base of the tray.

17. The icemaker assembly of claim 16, wherein each of the first channel and the second channel include a first arcuate wall and a second arcuate wall, respectively, and wherein the first arcuate wall and the second arcuate wall within each of the first channel and the second channel, respectively, direct the cool air within each of the first channel and the second channel uniformly along the tray.

18. The icemaker assembly of claim 14, further comprising:

a controller communicatively coupled to the tray; and a sensor coupled to a base of the tray and communicatively coupled to the controller, the sensor being configured to detect a threshold temperature of the tray.

* * * * *